US006583575B2

(12) United States Patent
Roh et al.

(10) Patent No.: US 6,583,575 B2
(45) Date of Patent: Jun. 24, 2003

(54) ENERGY RECOVERY SUSTAIN CIRCUIT FOR AC PLASMA DISPLAY PANEL

(75) Inventors: Chung-Wook Roh, Yongin (KR); Jea-Hyuk Lim, Cheonan (KR); Jung-Pil Park, Cheonan (KR)

(73) Assignee: Samsung Electronics Co., Ltd., Kyonggi-Do (KR)

( * ) Notice: Subject to any disclaimer, the term of this patent is extended or adjusted under 35 U.S.C. 154(b) by 0 days.

(21) Appl. No.: 09/953,174

(22) Filed: Sep. 17, 2001

(65) Prior Publication Data

US 2002/0047577 A1 Apr. 25, 2002

(30) Foreign Application Priority Data

Sep. 26, 2000 (KR) ..... 2000-56355

(51) Int. Cl.[7] ..... G09G 3/28

(52) U.S. Cl. ..... 315/169.1; 315/169.4; 345/37; 345/60

(58) Field of Search ..... 315/169.4, 169.1; 345/60, 37

(56) References Cited

U.S. PATENT DOCUMENTS 6,160,531 A * 12/2000 Chen et al. ..... 345/60

* cited by examiner

*Primary Examiner*—David Hung Vu
(74) *Attorney, Agent, or Firm*—Sughrue Mion, PLLC

(57) ABSTRACT

The present invention discloses an energy recovery sustain circuit for an AC plasma display panel in which includes one energy recovery sustain circuit incorporating X and Y electrodes. The invention includes a load capacitor, first and fourth switching elements to charge the load capacitor up to a predetermined positive voltage, a second and third switching elements to charge the load capacitor up to a predetermined negative voltage, a fifth switching element to apply an external voltage to the load capacitor to continually sustain the predetermined positive or negative voltage in the load capacitor during a certain period, an inductor for generating the certain leveled positive or negative voltage to charge the load capacitor, and first and second capacitors for charging or discharging a current flowing through the inductor. The invention has a simplified configuration, low production cost, and high reliability.

9 Claims, 4 Drawing Sheets

ENERGY RECOVERY SUSTAIN CIRCUIT FOR AC PLASMA DISPLAY PANEL

BACKGROUND OF THE INVENTION

1. Field of the invention

The present invention relates to a plasma display panel (PDP), and more particularly, to an energy recovery sustain circuit for an AC plasma display panel. This application is based on Korean Patent Application No. 2000-56355, filed on Sep. 26, 2000, the entirety of which is hereby incorporated by reference.

2. Description of Related Art

The AC plasma display panel is a type of a luminous device which uses gaseous discharge within each discharge cell for displaying an image. Because the AC plasma display panel is simple to fabricate, easy to fabricate into a large-sized screen, and fast in response, it is used as a direct view image display with a large screen, particularly as a display directed to a HDTV.

The AC plasma display panel provided with electrodes, a dielectric layer, and a discharge gas, acts as a load capacitor which charges and discharges. However, the large power consumption required to drive the AC plasma display panel, i.e., in the charging and discharging of the load capacitor, particularly when the size is great, has been a great obstacle for making AC plasma display panels popular. Accordingly, instead of a general sustain circuit, an energy recovery sustain circuit for sustained driving of the panel has been introduced, for pursuing low power consumption in a driving circuit which drives the AC plasma display panel. The energy recovery sustain circuit is a circuit provided with an inductor which forms an LC resonance circuit with a load capacitor in the panel for recovery and temporary storage of energy lost during discharge of the load capacitor and supplying the energy for the next charging of the load capacitor, thereby reducing energy loss in the sustained driving of the panel.

FIG. 1 is a circuit diagram illustrating a typical energy recovery sustain circuit, provided with a system including first and second energy recovery sustain driving parts 10 and 20 of identical systems, for supplying sustain pulses of a voltage Vs to a load capacitor Cp in the AC plasma display panel. Each of the first and second energy recovery sustain driving parts 10 and 20 is provided with an output terminal OUT connected to the load capacitor Cp, an inductor Lc having one end connected to the load capacitor Cp through the output terminal OUT to form a resonance circuit, a capacitor Cc having a capacitance greater than the load capacitor Cp and one end grounded for charging and discharging voltage Vs/2 thereto/therefrom, capacitor discharging means 11 connected to the other end of the capacitor Cc and the other end of the inductor Lc for discharging the voltage Vs/2 charged in the capacitor Cc so as to charge the load capacitor Cp from 0 to Vs, first voltage sustaining means 12 connected to the output terminal OUT for sustaining voltage Vp on both sides of the load capacitor Cp to Vs when the load capacitor Cp is charged to voltage Vs, capacitor charging means 13 connected between the other end of the capacitor Cc and the other end of the inductor Lc for discharging the voltage Vs charged in the load capacitor Cp down to 0 volts to charge the capacitor Cc up to voltage Vs/2, and second voltage sustaining means 14 connected to the output terminal OUT for sustaining a voltage Vp on both sides of the load capacitor Cp at 0 volts when the load capacitor Cp is discharged down to 0 volts. The capacitor discharging means 11 is provided with first switching means S1 having one end connected to the other end of the capacitor Cc, for being turned on while the load capacitor Cp is charged from 0 to voltage Vs, and a first diode D1 having an anode connected to the other end of the first switching means S1 and a cathode connected to the other end of the inductor Lc for receiving a current $I_L$ discharged from the capacitor Cc through the first switching means S1 and providing to the inductor Lc while the first switching means S1 is turned on. The capacitor charging means 13 is provided with second switching means S2 having one end connected to the other end of the capacitor Cc for being turned on while the load capacitor Cp is discharged from voltage Vs to 0 volts, and a second diode D2 having a cathode connected to the other end of the second switching means S2 and an anode connected to the other end of the inductor Lc for receiving a current $-I_L$ discharged from the load capacitor Cp through the inductor Lc and providing to the second switching means S2 while the first switching means S1 is at turned on. The first voltage sustaining means 12 is provided with a third diode D3 having a cathode connected to the output terminal OUT, and third switching means S3 having one end connected an anode of the third diode D3 and the other end connected to the Vs power source for being turned on when the load capacitor Cp is charged from 0 volts to voltage Vs. The second voltage sustaining means 14 is provided with a fourth diode D4 having an anode connected to the output terminal OUT, and fourth switching means S4 having one end connected to a cathode of the fourth diode D4 and the other end grounded for being turned on when the load capacitor Cp is discharged from voltage Vs to 0 volts.

The operation of charging and discharging of the aforementioned typical type energy recovery sustain circuit will be explained with reference to FIG. 2. FIG. 2 shows voltage and current waveform according to switching timings of the switching elements S1 to S4.

In the typical type energy recovery sustain circuit, when the entire system is turned on initially to have many continuous discharges at the load capacitor Cp, a current of discharge flows from the load capacitor Cp to respective capacitor Cc through the inductors Lc of the first and second energy recovery sustain driving part 10 and 20, to charge the respective capacitors Cc to voltage Vs/2. When a voltage Vs/2 is charged in each of the capacitors Cc of the first and second recovery sustain driving parts 10 and 20, periodic charging and discharging occurs between the typical energy recovery sustain circuit and the load capacitor Cp at proper intervals, making the energy recovery sustain drive for the AC plasma display panel. In this instance, the discharge in the load capacitor Cp is a sustain discharge for the AC plasma display panel. One cycle of the periodic charging and discharging between the typical energy recovery sustain circuit and the load capacitor Cp has four intervals, operations in each of which are different from one another.

<T1 INTERVAL>

In the T1 interval, the capacitors Cc of the first and second energy recovery sustain driving parts 10 and 20 are discharged to charge the load capacitors Cp with the discharge energies. In this T1 interval, only the first switching means S1 in the first and second energy recovery sustain driving parts 10 and 20 are turned on, while the other switching means S2, S3, and S4 are left turned off. When the first switching means S1 in the first and second energy recovery sustain driving parts 10 and 20 are turned on, the voltage Vs/2 charged in respective capacitors Cc are discharged, to flow a discharge current $I_L$ caused by the Vs/2 to the load capacitors Cp through the first switching means S1, the first diodes D1 and inductors Lc. At the end, the load capacitors Cp are charged up to voltage Vs in T1 interval by the discharge current $I_L$ from the first and second energy recovery sustain driving parts 10 and 20, respectively. Accordingly, a waveform rising from 0 volts to voltage Vs, i.e., a rising section of the sustain pulse, is shown at the output terminal OUT.

<T2 INTERVAL>

In the T2 interval after the T1 interval, voltage Vp at both ends of the load capacitor Cp is sustained at Vs, to charge the voltage Vs to the load capacitors Cp, continuously. In this T2 interval, only the third switching means S3 in the first and second energy recovery sustain driving parts 10 and 20 are turned on, while the other switching means S1, S2, and S4 are left turned off. When the third switching means S3 in the first and second energy recovery sustain driving parts 10 and 20 are turned on, a voltage from the Vs power source is provided to the output terminal OUT through the third switching means S3 and the third diode D3. As a result, the voltage Vs is continuously charged to the load capacitors Cp. That is, since the voltage V1 at both ends of the capacitor Cc is lower than the voltage Vp at both ends of the load capacitor Cp in this T2 interval, no discharge current $I_L$ flows through the inductor Lc. Therefore, for continuous charging to the load capacitors Cp, it is necessary to provide the voltage Vs to the output terminal OUT. Accordingly, in the T2 interval, a waveform held at the voltage Vs, i.e., a sustained section of the sustain pulse, is shown at the output terminal OUT.

<T3 INTERVAL>

In the T3 interval after the T2 interval, energies discharged from the load capacitors Cp are charged in the capacitors Cc in the first and second energy recovery sustain driving parts 10 and 20, respectively. In this T3 interval, only the second switching means S2 in the first and second energy recovery sustain driving parts 10 and 20 are turned on, while the other switching means S1, S3, and S4 are left turned off. When the second switching means S2 in the first and second energy recovery sustain driving parts 10 and 20 are turned on, voltage Vs charged in the load capacitors Cp are discharged. Therefore, a discharge current $-I_L$ flows to the capacitors Cc through the second switching means S2 via the inductors Lc and second diodes D2 in the first and second energy recovery sustain driving parts 10 and 20. As a result, during the T3 interval, the capacitors Cc are charged of voltage Vs/2 by the discharge current $-I_L$ from the load capacitors Cp. Therefore, in the T3 interval, a waveform falling from Vs to 0, i.e., a falling section of the sustain pulse, is shown at the output terminal OUT.

<T4 INTERVAL>

In the T4 interval after the T3 interval, voltage Vp at both ends of the load capacitors Cp are sustained at 0. In this T4 interval, only the fourth switching means S4 in the first and second energy recovery sustain driving parts 10 and 20 are turned on, while the other switching means S1, S2, and S3 are left turned off. When the fourth switching means S4 in the first and second energy recovery sustain driving parts 10 and 20 are turned on, the voltage at the output terminal OUT is sustained at 0 by the second voltage sustaining means 14. As a result, voltage Vp at both ends of the load capacitors Cp are sustained at 0 volts. In this instance, the voltage Vp at both ends of the load capacitors Cp is lower than the voltage Vs/2 at both ends of the capacitors Cc in the first and second energy recovery sustain driving parts 10 and 20, causing no discharge current$-I_L$ flow through the inductors Lc. Therefore, in the T4 interval, a waveform held at 0 volts, i.e., a sustained 0 volt section of the sustain pulse, is shown at the output terminal OUT.

A basic form of the sustain pulse provided to the load capacitors Cp in the AC plasma display panel during T1 to T4 is rectangular and is the same as the waveform of voltage Vout at the output terminal OUT. The waveforms of a current $I_L$ of the rising section (T1 interval) and of the falling section (T3 interval) in the sustain pulse are segments of a sinusoidal wave of a resonant oscillation of which frequency is determined by an inductance of the inductor Lc, a capacitance of the load capacitor Cp, and a capacitance of the capacitor Cc. It is apparent that, if the capacitor Cc is provided to a sustain circuit for temporary storage of a discharge energy from the load capacitor Cp and supplying the discharge energy as a charging energy to the load capacitor Cp in the next cycle, there is reduction in an energy loss with reduction of power consumption compared to a sustain circuit without the energy recovery. For example, while a power consumption of a current sustain circuit operative at a frequency of without the energy recovery is $P=CpVs^2fo$ during generation of sustain pulses, a power consumption of the typical type energy recovery sustain circuit is $P=Cp(Vs/2)^2fo$ during generation of sustain pulses, where Cp is a capacitance of a load capacitor, Vs is a sustain driving voltage and of is an operating frequency. Therefore, the typical energy recovery sustain circuit has a power consumption smaller than the current sustain circuit.

However, the typical energy recovery sustain circuit has the following disadvantages. Firstly, since it has a large number of switching elements, its configuration is very complicated. Secondly, since a high-cost MOSFET switch is used as the switching element, the production cost is very high. Thirdly, due to undesired parasitic components such as a parasitic resistance and a parasitic capacitor of the inductor, a parasitic resistance of the panel, a turn-on resistance of the switching, element and the like, the switching elements cannot perform an ideal zero voltage switching. Fourthly, since a sustaining discharge begins in the state that the capacitor Cc is not charged up to voltage Vs/2 yet, a very large abnormal current occurs. Therefore, a buffer circuit is required to prevent an occurrence of the abnormal current.

SUMMARY OF THE INVENTION

To overcome the problems described above, preferred embodiments of the present invention provide an energy recovery sustain circuit for an AC plasma display panel having a simplified configuration and a low production cost.

Another object of the present invention is to provide an energy recovery sustain circuit for an AC plasma display panel having a high reliability.

In order to achieve the above objects, the preferred embodiments of the present invention provide an energy recovery sustain circuit for an AC plasma display panel, including one energy recovery sustain circuit incorporating X and Y electrodes.

One energy recovery sustain circuit includes a load capacitor; first and fourth switching elements for being turned on to charge the load capacitor up to a predetermined positive voltage; second and third switching elements for being turned on to charge the load capacitor up to a predetermined negative voltage; a fifth switching element for being turned on to apply an external voltage to the load capacitor to continually sustain the certain leveled positive or negative voltage in the load capacitor during a certain period time; an inductor for generating the certain leveled positive or negative voltage to charge the load capacitor; and first and second capacitors for charging or discharging a current flowing through the inductor.

Each of the first to fifth switching elements has a body diode parallel-connected thereto, respectively. The load capacitor has a positive terminal and a negative terminal. The positive terminal of the load capacitor is connected to one end of each of the first and third switching elements. The negative terminal of the load capacitor is connected to one end of each of the second and fourth switching elements. One end of the fifth switching element is connected to the other ends of each of the first and second switching elements. A ground is connected to the other ends of the third and fourth switching elements. The first and second capacitors are serially connected to each other, one end of the first capacitor connected to the other end of the fifth switching element, one end of the second capacitor connected to the other ends of third and fourth switching elements.

The inductor has one end connected to the other ends of the first and second switching elements and the other end connected between the first and second capacitors. The external voltage has one end connected to the other end of the fifth switching element and the other end connected to the other ends of the third and fourth switching elements. Each of the first to fifth switching elements is a MOSFET switch. Each of the first to fifth switching elements becomes 0 volts when the electric current flows through the body diode, thereby performing a zero voltage switching.

The energy recovery sustain circuit for the AC plasma display panel according to the preferred embodiment of the present invention has a simplified configuration since two energy recovery sustain circuits are incorporated into one and the number of the switching elements is reduced. Further, since the switching elements perform an ideal zero voltage switching and an abnormal current at the beginning of the sustaining discharge is prevented, the energy recovery sustain circuit for the AC plasma display panel having a high reliability can be obtained.

BRIEF DESCRIPTION OF THE DRAWINGS

For a more complete understanding of the present invention and the advantages thereof, reference is now made to the following descriptions taken in conjunction with the accompanying drawings, in which like reference numerals denote like parts, and in which.

DETAILED DESCRIPTION OF PREFERRED EMBODIMENTS

Reference will now be made in detail to preferred embodiments of the present invention, example of which is illustrated in the accompanying drawings.

Figure 1:
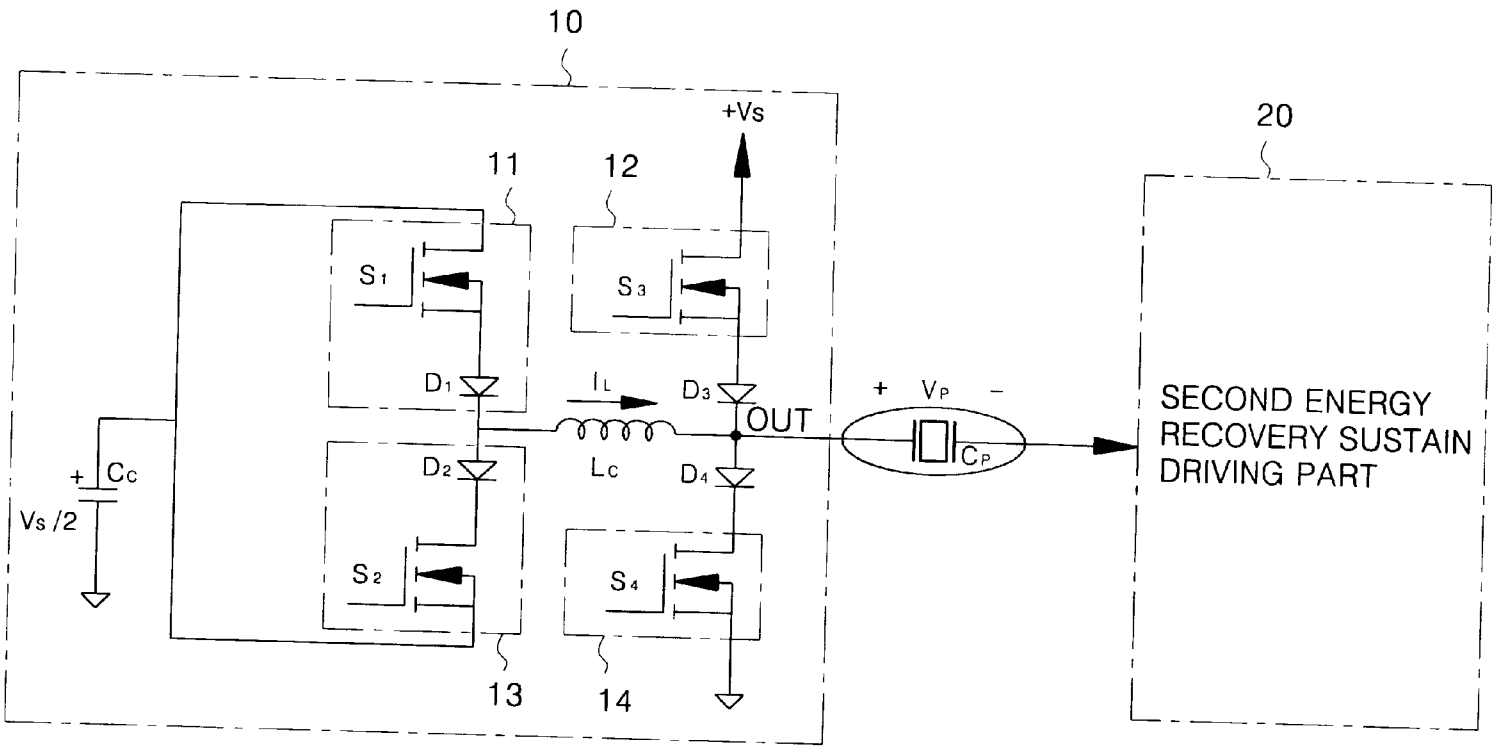
FIG. 1 (PRIOR ART)
FIG. 1 is a circuit diagram illustrating an energy recovery sustain circuit of an AC plasma display panel according to a conventional art.
Figure 2:
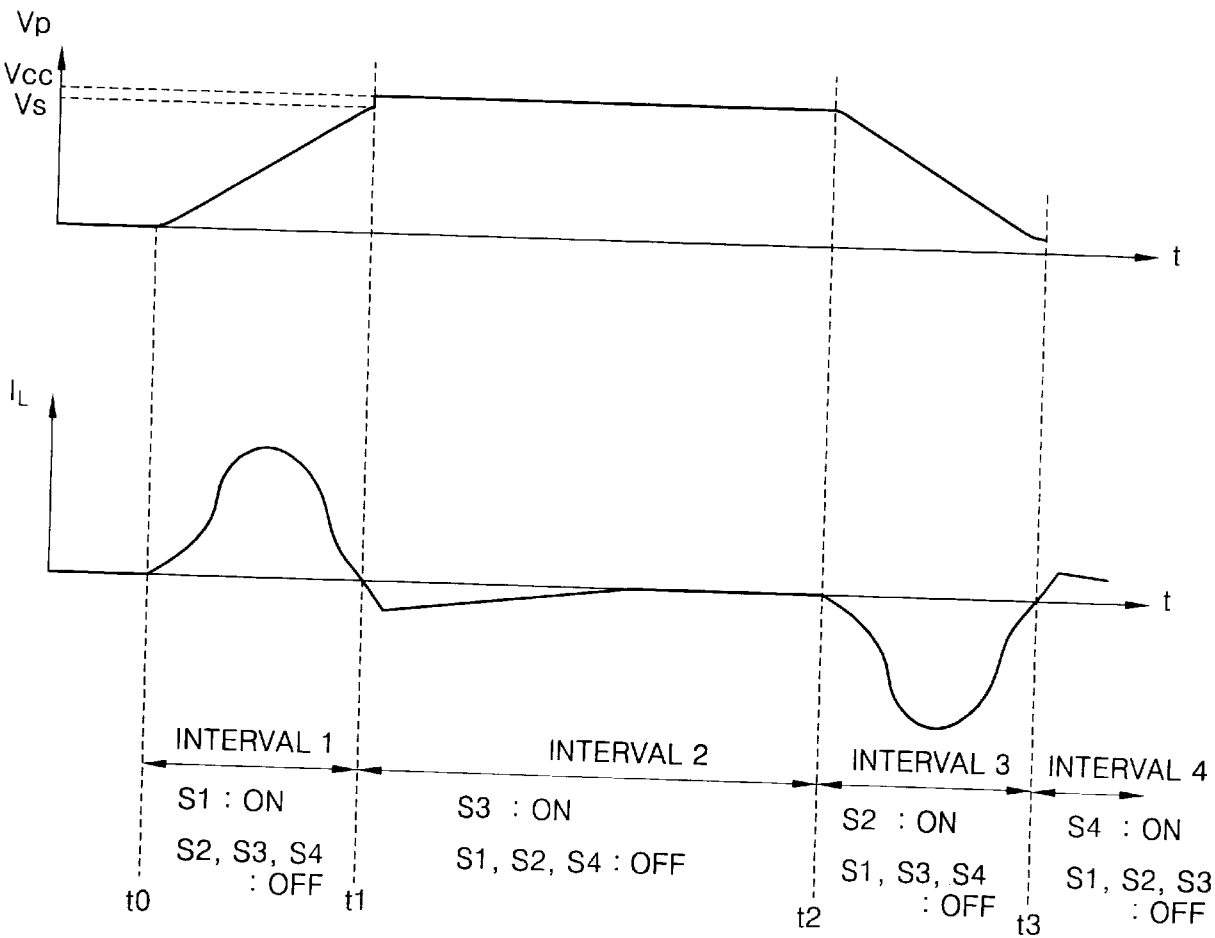
FIG. 2 shows voltage and current waveform according to switching timings of the switching elements according to a preferred embodiment of the present invention.
Figure 3:
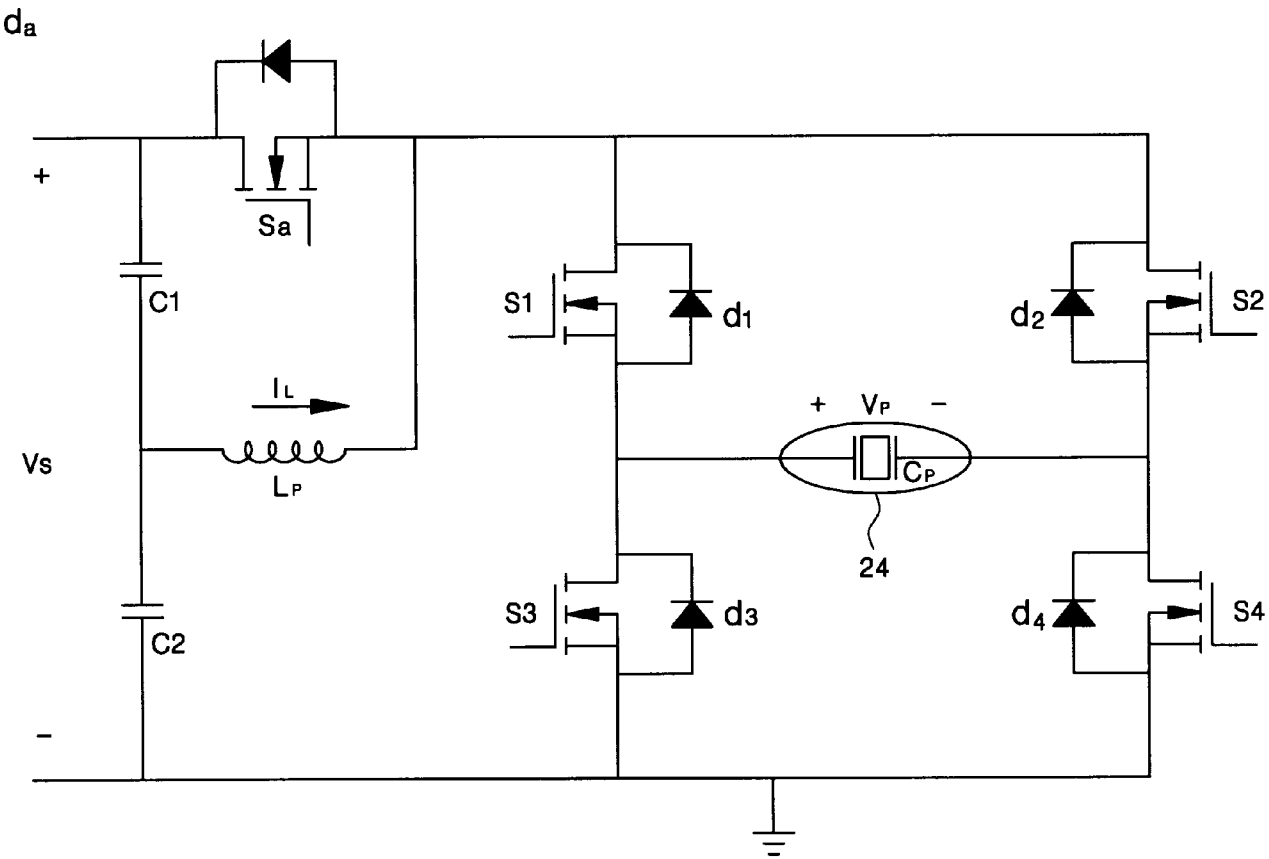
FIG. 3 is a circuit diagram illustrating an energy recovery sustain circuit for an AC plasma display panel according to the preferred embodiment of the present invention.

FIG. 3 is a circuit diagram illustrating an energy recovery sustain circuit for an AC plasma display panel according to the preferred embodiment of the present invention. As shown in FIG. 3, the energy recovery sustain circuit includes first to fourth switching elements S1, S2, S3, and S4 connected to a load capacitor Cp (i.e., a plasma display panel) in the form of a bridge. The switching elements S1, S2, S3, and S4 include body diodes d1, d2, d3, and d4 parallel-connected thereto, respectively. The third and fourth switching elements S3 and S4 are connected with a ground. A fifth switching element Sa includes one end connected with the first and second switching elements S1 and S2, and the other end connected with a positive terminal of a voltage Vs and a first capacitor C1. A second capacitor C2 has one end connected with a negative terminal of the voltage Vs, and the third and fourth switching elements S3 and S4, and the other end connected with the first capacitor C. At this time, the first and second capacitors C1 and C2 are charged up to voltage Vs/2, respectively, and thus when a sustaining discharge begins, an abnormal current can be prevented. An inductor Lp has one end connected with the first and second capacitors C1 and C2 and the other end connected with the first, second, and fifth switching elements S1, S2, and Sa. At this point, each of the switching elements S1 to S4, and Sa is, preferably, a MOSFET switch.

Figure 4:
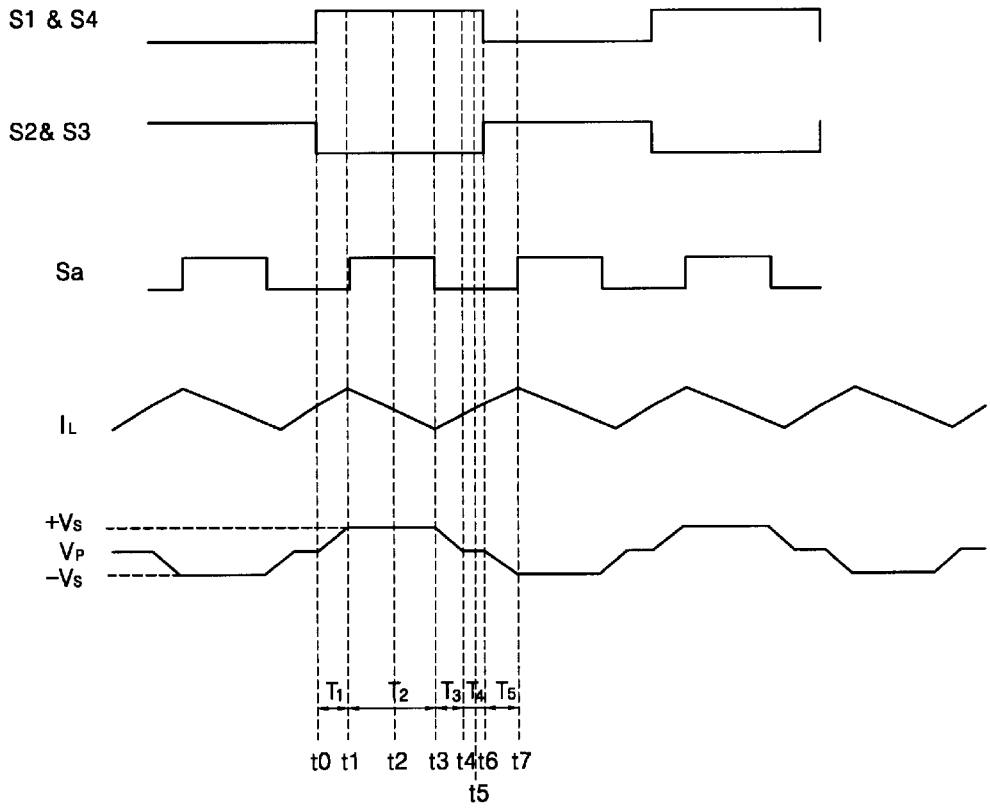
FIG. 4 shows voltage and current waveform according to switching timings of the switching elements according to the preferred embodiment of the present invention.

An operation of the energy recovery sustain circuit for the AC plasma display panel according to the preferred embodiment of the present invention is explained in detail with reference to FIG. 4. FIG. 4 shows voltage and current waveforms according to switching timings of the first to fifth switching elements. At this point, the current wave form is a triangular wave form. One cycle of the periodic operation of the energy recovery sustain circuit for the AC plasma display panel includes five intervals, operations in each of which are different from one another.

<T1 INTERVAL>

In the T1 interval of a time t0 to a time t1, the second capacitor C2 is discharged to charge the load capacitor Cp with the discharge energy. The first and fourth switching elements S1 and S4 are turned on, while the second, third and fifth switching elements S2, S3, and Sa are left turned off. When the first and fourth switching elements S1 and S4 are turned on, a discharge current $I_L$ flows to the load capacitor Cp through the first switching element S1, so that the load capacitor Cp is charged up to voltage Vs in the T1 interval. Thereafter, the current $I_L$ flows from the fourth switching element S4 to the ground.

<T2 INTERVAL>

In the T2 interval of a time t1 to a time t3, voltage Vp at both ends of the load capacitor Cp is sustained at Vs, to charge the voltage Vs to the load capacitor Cp, continuously. The first, fourth, and fifth switching elements S1, S4, and Sa are turned on, while the second and third switching elements S2 and S3 are left turned off. When the load capacitor Cp is charged up to voltage Vs, the discharge current $I_L$ flows via the fifth body diode da. Voltages at both ends of the fifth switching element Sa become 0 volts, so that the fifth switching element Sa is turned on. That is, the fifth switching element Sa performs an ideal zero voltage switching. As a result, the voltage Vs is applied to sustain voltage Vs at both ends of the load capacitor Cp through the first switching element S1. Further, the first capacitor C1 is charged by the current $-_L$ that flows in a direction opposite to the current $I_L$ and is caused by application of the voltage Vs. Therefore, a current amount of the current $I_L$ is gradually reduced. A polarity of the current $I_L$ is inversed at a time t2, so that a negative current $-I_L$ flows through the inductor Lp. At this time, the first capacitor C1 is discharged by the time t3. In the T2 interval, the plasma display panel performs a plasma discharge to display images.

<T3 INTERVAL>

In the T3 interval of the time t3 to a time t4, voltage Vp at both ends of the load capacitor Cp is reduced from voltage Vs to 0 volts. The first and fourth switching elements S1 and S4 are turned on, while the second, third and fifth switching elements S2, S3, and Sa are left turned off. When the fifth switching element Sa is turned off, due to a negative current $-I_L$ that flows through the inductor Lp, a resonance circuit having a path (S4-Cp-S1-Lp) is formed, so that voltage Vp at both ends of the load capacitor Cp is reduced up to 0 volts. At this time, the second capacitor C2 is charged.

<T4 INTERVAL>

In the T4 interval of the time t4 to a time t6, voltage Vp at both ends of the load capacitor Cp is sustained at 0 volts. The first and fourth switching elements S1 and S4 are turned on, while the second, third and fifth switching elements S2, S3, and Sa are left turned off at the time t4. At this time, voltage Vp at both ends of the load capacitor Cp becomes at 0 volts. During the time t4 to the time t5, the second capacitor C2 is charged, an amount of the negative current $-I_L$ is gradually reduced. At the same time, the current $I_L$ flows to the second body diode d2 and the third body diode d3, whereby the second and third switching elements S2 and S3 are turned on at a time t6. In other words, when the current $I_L$ flows to the second body diode d2 and the third body diode d3, the second and third switching elements S2 and S3 become 0 volts, whereby the second and third switching elements S2 and S3 perform an ideal zero voltage switching.

The second capacitor C2 begins to discharge at a time t5, and thus an amount of a positive current $I_L$ increases gradually.

<T5 INTERVAL>

In the T5 interval of the time t6 to a time t7, negative voltages are applied to charge the load capacitor Cp. In other words, a resonance circuit having a path (C2-Lp-S2-Cp-S3) is formed, and voltage Vp at both ends of the load capacitor Cp is gradually reduced. The second and third switching elements S2 and S3 are turned on, while the first, fourth and fifth switching elements S1, S4, and Sa are left turned off at the time t6. When the second and third switching elements S2 and S3 are turned on, the second capacitor C2 is discharged, and the positive current $I_L$ flows to the load capacitor Cp through the third switching element S3, whereupon that the load capacitor Cp is charged up to voltage −Vs in the T5 interval. Thereafter, the current $I_L$ flows from the third switching element S3 to the ground.

At this state, the fifth switching elements is turned on again, another cycle of the periodic operation of the energy recovery sustain circuit for the AC plasma display panel begins.

As described herein before, the energy recovery sustain circuit for the AC plasma display panel according to the preferred embodiment of the present invention has a simplified configuration since two energy recovery sustain circuits are incorporated into one and the number of the switching elements is reduced. Further, since the switching elements perform an ideal zero voltage switching and an abnormal current at the beginning of the sustaining discharge is prevented, the energy recovery sustain circuit for the AC plasma display panel having a high reliability can be obtained.

While the invention has been particularly shown and described with reference to preferred embodiments thereof, it will be understood by those skilled in the art that the foregoing and other changes in form and details may be made therein without departing from the spirit and scope of the invention.

What is claimed is:

1. An energy recovery sustain circuit for an AC plasma display panel, the energy recovery sustain circuit incorporating X and Y electrodes and comprising:

a load capacitor;

a first switching element and a second switching element, each for being turned on to charge the load capacitor up to a predetermined positive voltage;

a third switching element and a fourth switching element, each for being turned on to charge the load capacitor up to a predetermined negative voltage;

a fifth switching element for being turned on to apply an external voltage to the load capacitor to continually sustain one of the predetermined positive voltage and the predetermined negative voltage in the load capacitor during a certain period;

an inductor for generating the predetermined positive voltage and the predetermined negative voltage to charge the load capacitor; and a first capacitor and a second capacitor, each for charging and discharging a current flowing through the inductor.

2. The circuit of claim 1, wherein each of the first to the fifth switching elements has a body diode parallel-connected thereto, respectively.

3. The circuit of claim 1, wherein the load capacitor has a positive terminal and a negative terminal;

the positive terminal of the load capacitor is connected to both one end of the first switching element and one end of the fourth switching element;

the negative terminal of the load capacitor is connected to both one end of the second switching element and one end of the third switching element;

one end of the fifth switching element is connected to both other end of the first switching element and other end of the third switching element;

a ground is connected to both the other end of the second switching element and the other end of the fourth switching element;

the first capacitor and the second capacitor are serially connected to each other, one end of the first capacitor connected to the other end of the fifth switching element, one end of the second capacitor connected to both other ends of the second and the fourth switching elements;

the inductor having one end connected to both other ends of the first and the third switching elements, and other end of the inductor connected between the first and the second capacitors; and the external voltage having one end connected to the other end of the fifth switching element, and other end of the external voltage connected to both the other ends of the second and the fourth switching elements.

4. The circuit of claim 1, wherein each of the first to the fifth switching elements is a MOSFET switch.

5. The circuit of claim 2, wherein each of the first to the fifth switching elements has 0 volts when the electric current flows through the body diode of the respective switching element, thereby performing a zero voltage switching.

6. An energy recovery sustain circuit for an AC plasma display panel, the energy recovery sustain circuit incorporating X and Y electrodes and comprising:

a load capacitor having a positive terminal and a negative terminal;

a first MOSFET switch and a second MOSFET switch, each for being turned on to charge the load capacitor up to a predetermined positive voltage;

a third MOSFET switch and a fourth MOSFET switch, each for being turned on to charge the load capacitor up to a predetermined negative voltage, wherein the positive terminal of the load capacitor is connected to both one end of the first MOSFET switch and one end of the fourth MOSFET switch, and the negative terminal of the load capacitor is connected to both one end of the third MOSFET switch and one end of the second MOSFET switch;

a fifth MOSFET switch for being turned on to apply an external voltage to the load capacitor to continually sustain one of the predetermined positive voltage and the predetermined negative voltage in the load capacitor during a certain period, the external voltage having one end connected to other end of the fifth MOSFET switch, and other end of the external voltage connected to both other end of the fourth MOSFET switch and other end of the second MOSFET switch, wherein one end of the fifth MOSFET switch is connected to both other end of the first MOSFET switch and other end of the third MOSFET switch;

a ground connected to both the other ends of the fourth and the second MOSFET switch;

an inductor for charging the load capacitor to one of the predetermined positive voltage and the predetermined negative voltage, the inductor having one end connected to both the other ends of the first and the third MOSFET switches; and a first capacitor and a second capacitor, each for charging and discharging a current flowing through the inductor, the first and the second capacitor serially connected to each other, one end of the first capacitor connected to the other end of the fifth MOSFET switch, one end of the second capacitor connected to both the other ends of the fourth and the second MOSFET switches, other end of the inductor connected between the first and the second capacitors, a body diode parallel-connected to each of the first to the fifth MOSFET switches, each of the first to the fifth MOSFET switches having 0 volts when the electric current flows through the body diode of the respective MOSFET switch, thereby performing a zero voltage switching.

7. An energy recovery sustain circuit for an AC plasma display panel, the energy recovery sustain circuit incorporating X and Y electrodes and comprising:

charge storing means for storing electrical energy and blocking the flow of direct current;

a first selective means and a second selective means, each for one of opening and closing a circuit, and each for charging the charge storing means up to a predetermined positive voltage;

a third selective means and a fourth selective means, each for one of opening and closing a circuit, and each for charging the charge storing means up to a predetermined negative voltage;

a fifth selective means for applying an external voltage to the charge storing means, continually sustaining the charge storing means at one of the predetermined positive voltage and the predetermined negative voltage during a certain period;

current generating means for charging the charge storing means to one of the predetermined positive voltage and the predetermined negative voltage; and a first voltage storing means and a second voltage storing means, each for charging or discharging a current flowing through the current generating means.

8. The circuit of claim 7, wherein each of the first to the fifth selective means has one-way conductor means for limiting a direction of current flow to one direction, each one-way conductor means connected in parallel with its respective selective means.

9. The circuit of claim 8, wherein each of the first to the fifth selective means has 0 volts when the electric current flow through the one-way conducting means, thereby performing a zero-voltage switching.

* * * * *